US005822889A

United States Patent [19]

Ueda

[11] Patent Number: 5,822,889

[45] Date of Patent: Oct. 20, 1998

[54] BICYCLES SHOES

[75] Inventor: Yutaka Ueda, Sakai, Japan

[73] Assignee: Shimano, Inc., Osaka, Japan

[21] Appl. No.: 921,755

[22] Filed: Aug. 26, 1997

Related U.S. Application Data

[63] Continuation of Ser. No. 595,985, Feb. 6, 1996, abandoned.

[30] Foreign Application Priority Data

Feb. 10, 1995 [JP] Japan ..... 7-045110

[51] Int. Cl.[6] ..... A43B 5/14

[52] U.S. Cl. ..... 36/131

[58] Field of Search ..... 36/7.3, 4, 131, 36/128, 135

[56] References Cited

U.S. PATENT DOCUMENTS

| | | | |
|---|---|---|---|
| 31,730 | 3/1861 | Meyer | 36/7.3 X |
| 277,614 | 5/1883 | Roosevelt | 36/7.3 |
| 288,127 | 11/1883 | Shepard | 36/7.3 |
| 1,067,754 | 7/1913 | Pearce | 36/7.3 |
| 1,841,710 | 1/1932 | Byrne et al. | 36/7.3 |
| 3,559,310 | 2/1971 | Kiela | 36/7.3 |
| 3,643,352 | 2/1972 | Adair | 36/7.3 |
| 4,222,182 | 9/1980 | Sears | 36/44 |
| 4,739,564 | 4/1988 | Eser | 36/131 |
| 4,825,565 | 5/1989 | Bigolin | 36/131 |
| 4,893,420 | 1/1990 | Bezin | 36/131 |
| 5,185,944 | 2/1993 | Okajima | 36/45 |
| 5,363,573 | 11/1994 | Kilgore et al. | 36/131 |

FOREIGN PATENT DOCUMENTS

| | | | |
|---|---|---|---|
| 553934 | 8/1993 | European Pat. Off. | 36/131 |
| 2683981 | 5/1993 | France | 36/131 |
| 3631302 | 4/1987 | Germany | 36/131 |
| 383599 | 11/1932 | United Kingdom . | |
| 2252029 | 7/1992 | United Kingdom . | |

OTHER PUBLICATIONS

European search report for EP 96300935.2, dated May 20, 1997.

*Primary Examiner*—Ted Kavanaugh
*Attorney, Agent, or Firm*—James A. Deland

[57] ABSTRACT

A bicycle shoe has a sole portion including an inflection point substantially in a longitudinal central portion of the sole, an inflection point front portion having a convex shape in front of the inflection point, and an infection point back portion having a concave shape behind the inflection. A heel portion having a convex shape for fitting to a heel is continuously and smoothly connected to a back end portion of the sole portion; left and right side portions are smoothly and continuously connected to corresponding left and right side portions of the sole portion and to the heel portion; and a toe portion is smoothly and continuously connected to front end portions of the left and right side portion structures and to the sole portion. The toe portion has a contour line that is closed within a lateral cross section thereof and which has a convex shape, and a radius of curvature of a longitudinal cross section of the toe portion is approximately equal to a radius of curvature of a toe disposed in that position.

2 Claims, 12 Drawing Sheets

15
15
15
13
4
5
6
1
2
3
0
8
6
9
4
5
6
1
2
3
0
13
14
14
14

0
23
24
4
5
6
3
1
3a
2
8
22
21
1b
1a
1c
1d
25

BICYCLES SHOES

This is a Continuation of application Ser. No. 08/595,985, filed Feb. 6, 1996, now abandoned.

BACKGROUND OF THE INVENTION

The present invention is directed to bicycle shoes and, more particularly, to a bicycle shoe for coupling to a bicycle pedal which retains walking comfort and stiffness.

Walking comfort is a desirable feature for walking shoes, and such comfort is determined by the elastic bendability of the shoe. Sports shoes, while having excellent walking comfort because they follow the elastic deformation of foot muscles, possess poor stiffness. Thus, when a person wearing such sports shoes applies a force to bicycle pedals, the shoes, foot soles, and toes undergo substantial deformation, a large amount of energy is lost, and foot fatigue is considerable.

Conventional bicycle shoes which couple to the pedals via coupling portions on the soles are effective in transmitting the force to the pedals. Such bicycle shoes typically have flat soles and possess considerable stiffness. However, the stiffness resulting from the flat soles provides poor walking comfort. Furthermore, the shape of the space between the sole portion and the toe portion does not conform to the shape of the toe portion. Consequently, considerable energy loss is induced by the relative movement of the foot and the shoe, walking comfort further deteriorates, and foot fatigue is substantial.

SUMMARY OF THE INVENTION

The present invention is directed to a bicycle shoe that provides excellent stiffness and low energy loss while maintaining walking comfort and low foot fatigue. In one embodiment of the present invention, a bicycle shoe has a sole portion including an inflection point substantially in a longitudinal central portion of the sole, an inflection point front portion having a convex shape in front of the inflection point, and an inflection point back portion having a concave shape behind the inflection point. During walking, the shoe tends to bend at the inflection point. However, with this structure, the central portion can be easily bent in the upward direction of rotation, but is difficult to bend in the downward direction of rotation. Such bending characteristics improve walking comfort and at the same time allow effective transmission of pedaling force.

In this embodiment, a heel portion having a convex shape for fitting to a heel is continuously and smoothly connected to a back end portion of the sole portion; left and right side portions are smoothly and continuously connected to corresponding left and right side portions of the sole portion and to the heel portion; and a toe portion is smoothly and continuously connected to front end portions of the left and right side portions and to the sole portion. The toe portion has a contour line that is closed within a lateral cross section thereof and which has a convex shape. If desired, a radius of curvature of a longitudinal cross section of the toe portion is approximately equal to a radius of curvature of a toe disposed in that position. Such a structure conforms more closely to the foot, thus eliminating excessive movement between the foot and the shoe.

BRIEF DESCRIPTION OF THE DRAWINGS

FIGS. 7(A)–7(G) show a particular embodiment of a bicycle shoe according to the present invention at various stages of manufacture, wherein FIGS. 7(A)–7(C) are right side views of the shoe, FIG. 7(D) is a bottom view of the shoe, and FIGS. 7(E)–7(G) are left side views of the shoe;

FIGS. 10(A)–10(G) show an alternative embodiment of a bicycle shoe according to the present invention at various stages of manufacture, wherein FIGS. 10(A)–10(C) are right side views of the shoe, FIG. 10(D) is a bottom view of the shoe, and FIGS. 10(E)–10(G) are left side views of the shoe;

DETAILED DESCRIPTION OF THE EMBODIMENTS

Figure 1A:
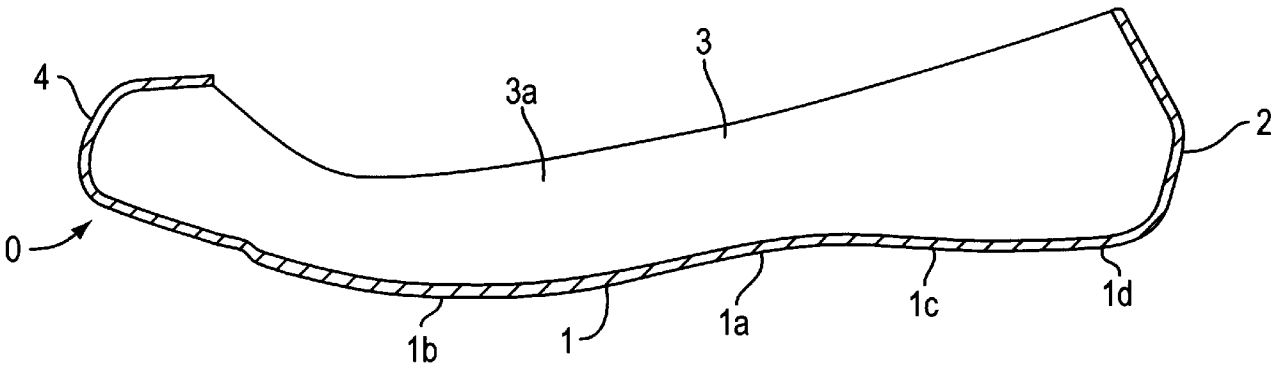
FIGS. 1A and 1B are left and right longitudinal cross sectional views of a particular embodiment of a bicycle shoe body according to the present invention.
Figure 1B:
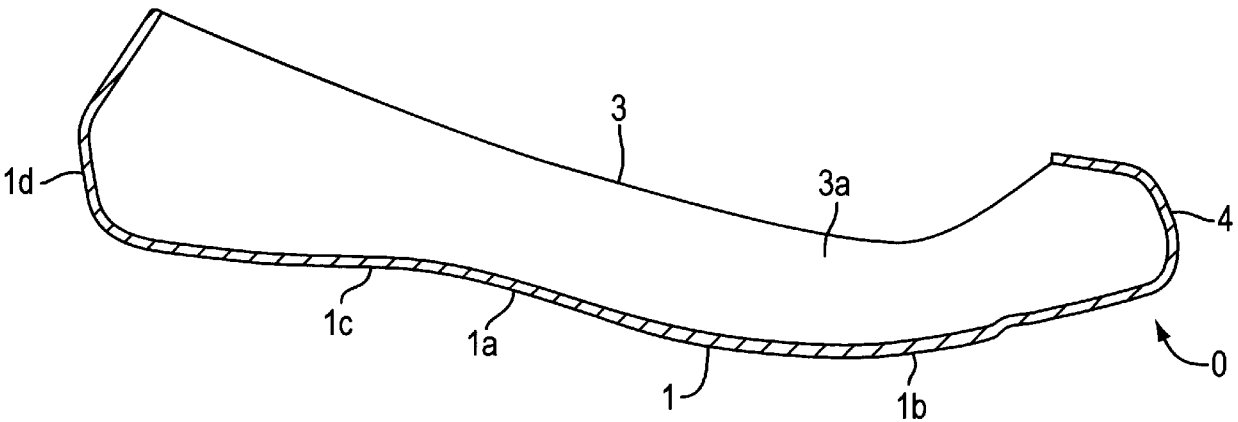
Figure 9:
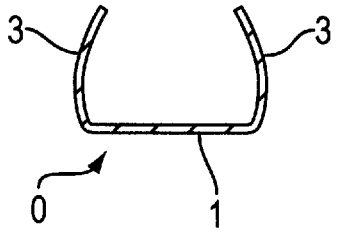
FIG. 9 is a lateral cross sectional view of the shoe body shown in FIG. 1.

FIGS. 1A and 1B are left and right longitudinal cross sectional views, respectively, of a particular embodiment of a bicycle shoe body 0 according to the present invention, and FIG. 9 is a lateral cross sectional view of the shoe body 0 shown in FIGS. 1A and 1B. The shoe body 0 shown in FIGS. 1A, 1B and 9 is a monolithic body that may be molded by injection molding, blow molding, wipe molding involving mold coating, or another commonly used technique. Although this allows the sole portion of the shoe body 0 to be classified as a molded sole article in accordance with the conventional method for classifying bicycle shoes, this sole portion will hereinafter be referred to as a sole portion structure 1. The shoe body 0 comprises a sole portion structure 1, a heel portion structure 2, left and right side portion structures 3, and a toe portion structure 4 that are integrally formed from a resin by injection molding.

Figure 2:
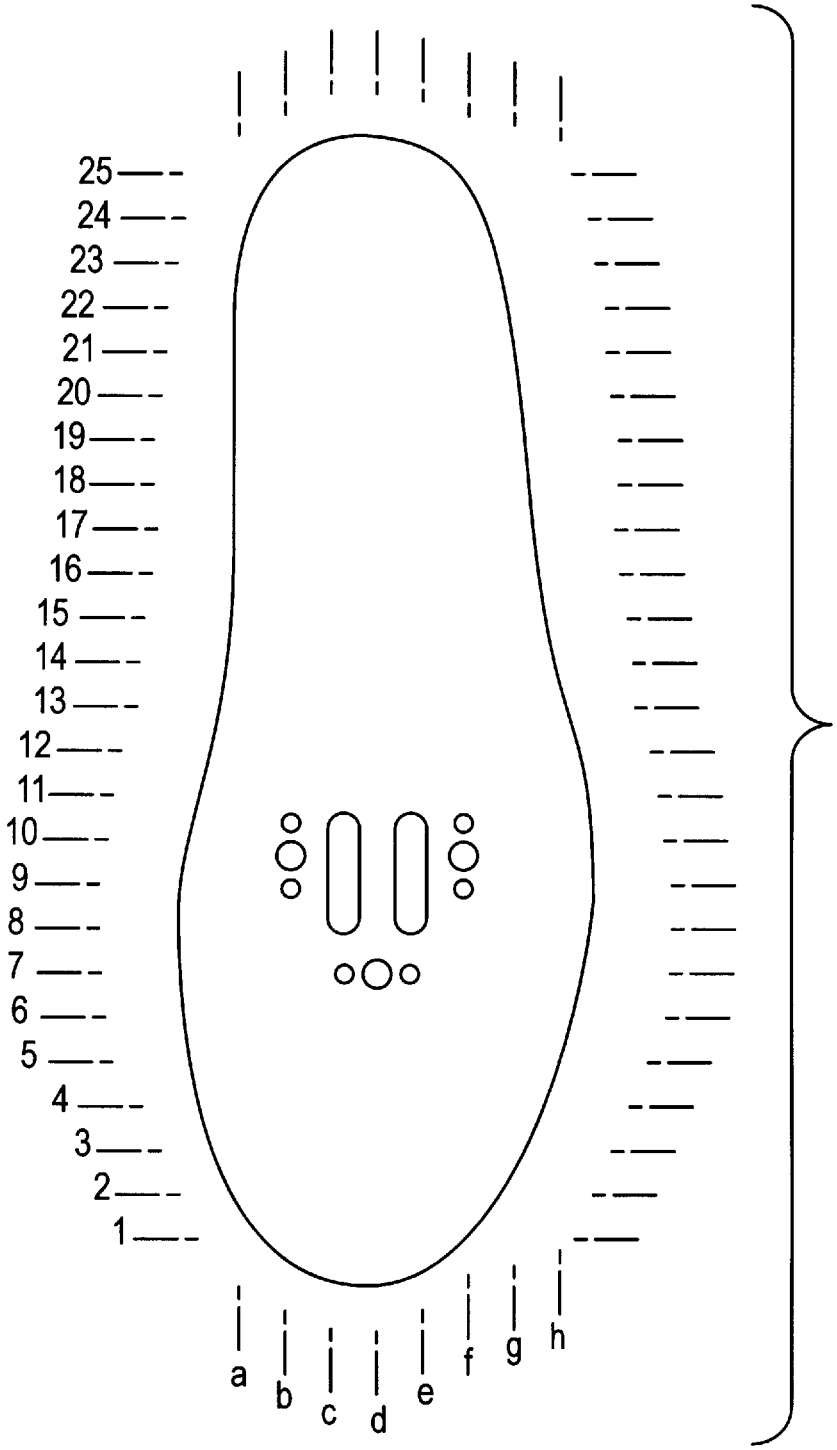
FIG. 2 is a bottom view of the shoe body shown in FIG. 1 illustrating coordinate positions of the shoe.

FIG. 2 is a bottom view of the shoe body 0 showing coordinates that correspond to cross-sectional views shown in FIGS. 3–6. The eight ordinate positions in FIG. 2 are indicated by the letters (a), (b), . . . , (g), and (h), and the 25 abscissa positions are indicated by the numbers 1, 2, . . ., 24, and 25. The letters and numbers in parentheses in FIGS. 3, 4, 5, and 6 indicate the cross sections for the positions corresponding to the same letters and numbers in FIG. 2.

Figure 5:
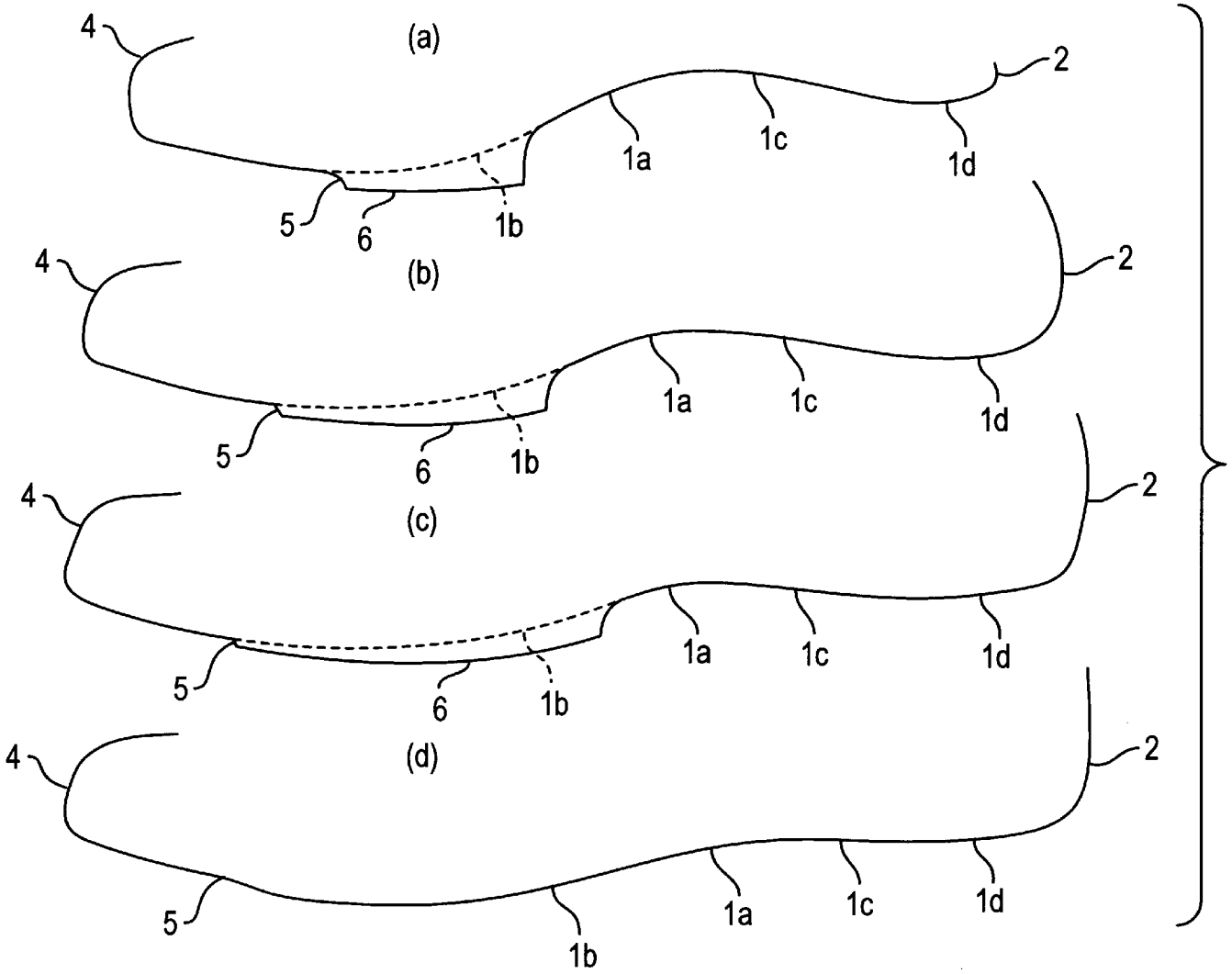
FIG. 5 show longitudinal cross sectional views of the shoe body taken along coordinates A–D in FIG. 2.
Figure 6:
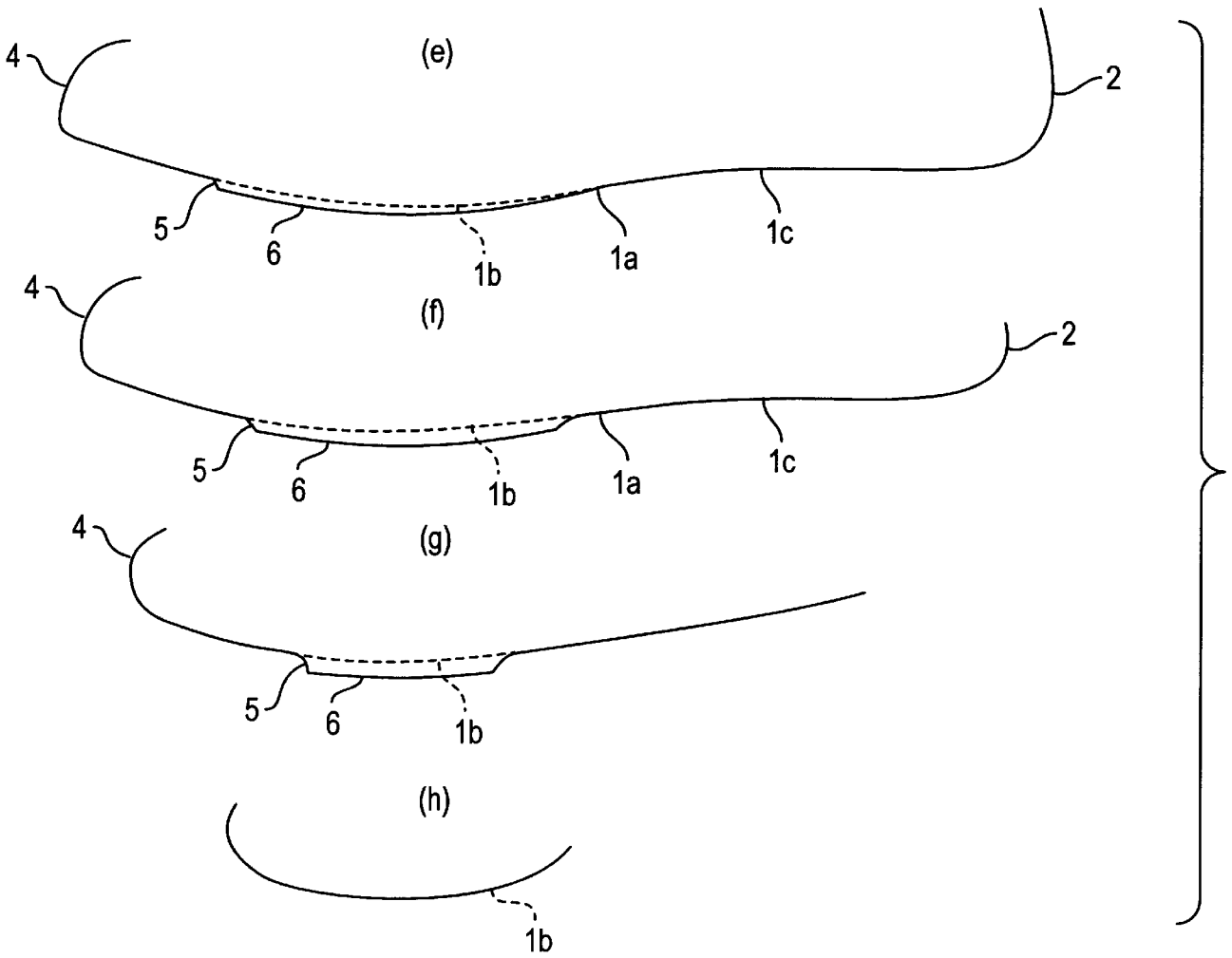
FIG. 6 shows longitudinal cross sectional views of the shoe body taken along coordinates E–H in FIG. 2.

As shown in FIGS. 5 and 6, the sole line of the sole portion structure 1 has an inflection point 1*a* roughly in the longitudinal central portion of the shoe body 0. An inflection point front portion 1*b* in front of the inflection point 1*a* is roughly in the form of a convex surface, and an inflection point back portion 1*c* behind the inflection point 1*a* is roughly in the form of a concave surface. A heel portion bottom 1*d* that follows the inflection point back portion 1*c* and is continuous with it is shaped partially as an essentially convex surface, as shown in views (a) and (b) in FIG. 5, and partially as an essentially flat surface, as shown in views (c),(d) and (e). The sole structure 1 is formed by the inflection point front portion 1*b*, inflection point back portion 1*c*, and heel portion bottom 1*d*.

A heel portion structure 2 is continuously and smoothly connected to the back end portion of the heel portion bottom 1*d* of the sole portion structure 1. As shown in views (b),(c) and (d) in FIG. 5 and view (e) in FIG. 6, the heel portion structure 2 is shaped as a convex curved surface that resembles the convex curved surface of the back surface of the heel of the foot.

Left and right side portion structures 3, which are smoothly and continuously connected to the left and right end portions of the aforementioned sole portion structure 1 and to the aforementioned heel portion structure 2, rise essentially vertically, as shown in FIG. 9. The left and right side portion structures 3 are slightly curved in such a way that the distance between them decreases in the upward direction.

A toe portion structure 4 is smoothly and continuously connected to the front end portions of the left and right side portion structures 3 and the sole portion structure 1. Viewed in a lateral cross section, the front portion of the toe portion structure 4 is such that the form line of the toe portion structure 4 has a closed contour line, as shown in views (1) and (2) in FIG. 3, and it is shaped as a convex surface as shown in FIGS. 5 and 6. The leading surface of the toe portion structure 4 is shaped as a convex curved surface that resembles the convex curved surface of the leading surfaces of the toes of the foot. More specifically, the radius of curvature of the curve in the front cross section of the connecting portion designed to ensure a continuous and smooth connection of the sole structure 1 to the toe portion structure 4 is roughly equal to the radius of curvature of each toe.

Figure 3:
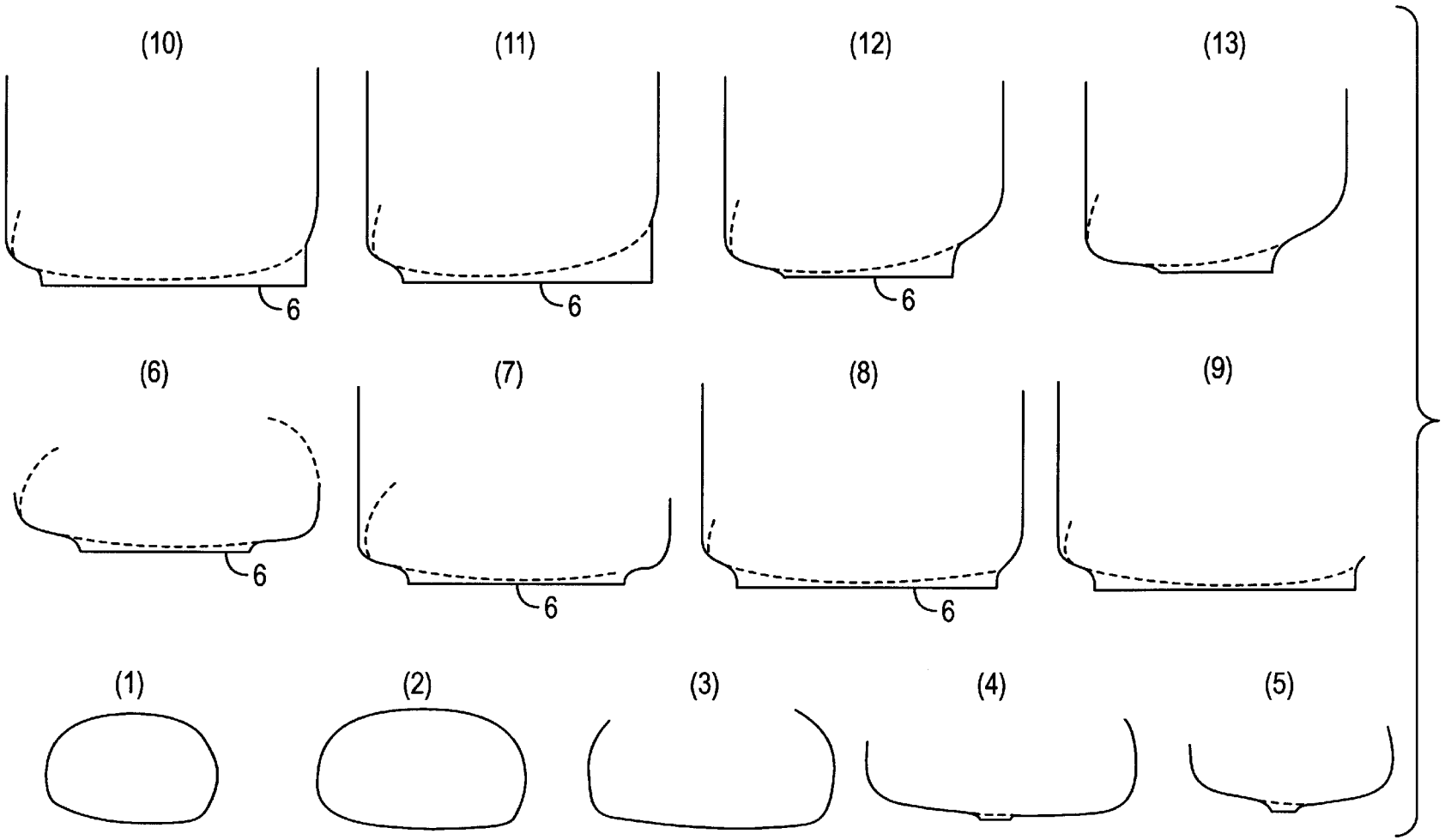
FIG. 3 shows lateral cross sectional views of the shoe body taken along coordinates 1–13 in FIG. 2.
Figure 4:
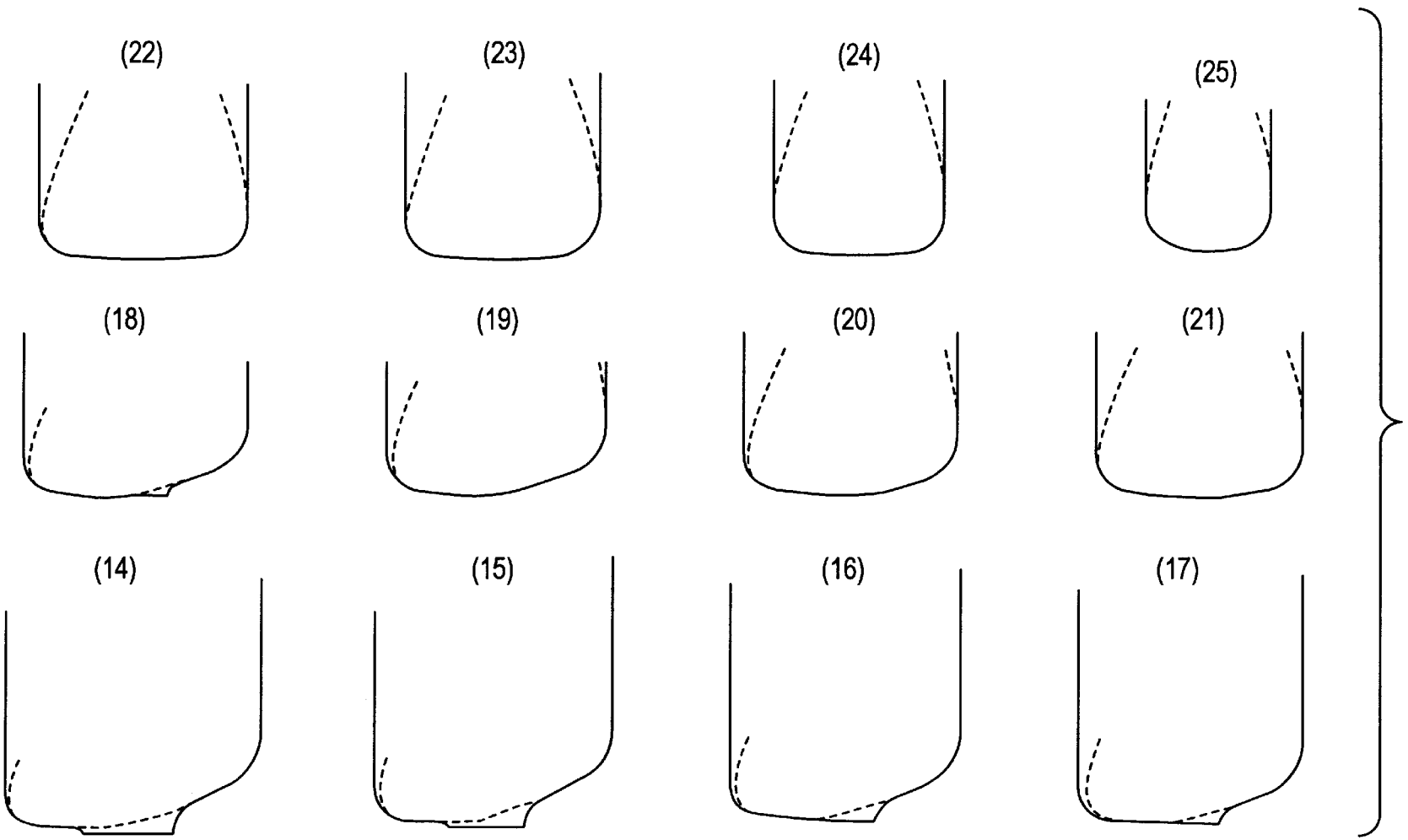
FIG. 4 shows lateral cross sectional views of the shoe body taken along coordinates 14–25 in FIG. 2.

The inflection point front portion 1*b* is provided with a low-grade portion 6 which is separated from the toe portion structure 4 by a stepped portion 5 and which is shaped as a lower-grade step in a continuous manner, as shown in FIGS. 3,5 and 6.

Figures 7A, 7B, 7C, 7D, 7E, 7F, 7G:
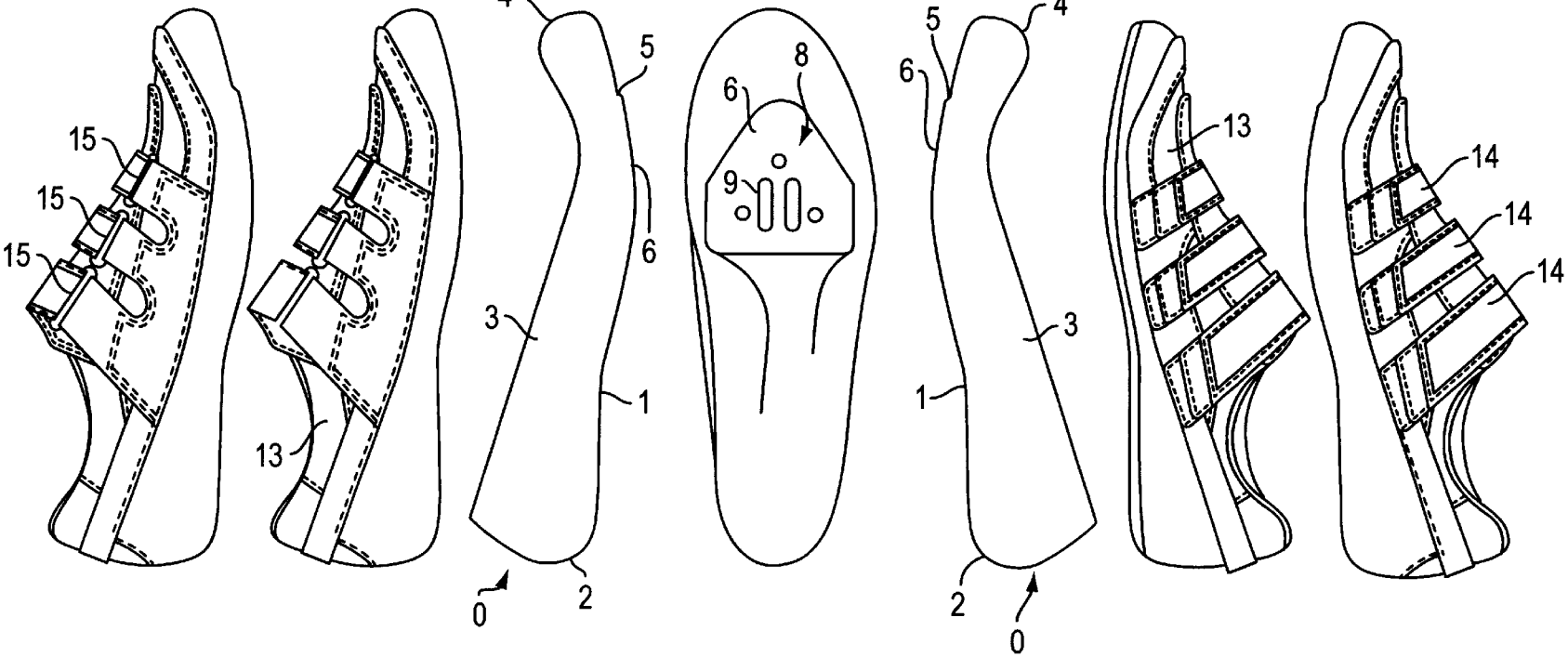

FIGS. 7(A)–7(G) show a particular embodiment of a bicycle shoe according to the present invention at various stages of manufacture, wherein FIGS. 7(A)–7(C) are right side views of the shoe, FIG. 7(D) is a bottom view of the shoe, and FIGS. 7(E)–7(G) are left side views of the shoe. As shown in FIG. 7(D), a coupling portion 8 for coupling the sole portion structure 1 with the bicycle pedal is formed in the central portion of the low-grade portion 6. Long holes 9 that extend in the longitudinal direction parallel to each other are formed in the coupling portion 8. The bicycle shoe 11 can be fixed to the pedal while its position in the longitudinal direction can be adjusted using the long holes 9 with the aid of conventional means.

An inner shoe 13 (FIGS. 7(B) and 7(F) is inserted into the shoe body 0. FIGS. 7(A) and 7(G) show the inner shoe 13 inserted into shoe body 0, so only those portions of the inner shoe 13 that extend outside of the shoe body 0 can be seen. The upper rim of the inner shoe 13 may be stitched with a sewing thread using the moving needle of a sewing means, as shown by the dotted lines in FIGS. 7(A) and 7(G). Stitch bonding is reinforced with an adhesive. Three pairs of left and right Velcro® straps 14 are sewn to the left and right sides of the upper rim portion of the inner shoe 13. Each pair of the Velcro® straps 14 is easily fastened in a stretched state by a commonly used means.

As shown in FIG. 7(A), a tightening ring 15, for example, is attached by a sewing means to the end portion of one strap of each pair of Velcro® straps 14. The outer surface of the inner shoe 13 and the inner surface of the shoe body 0 are fixed to each other to ensure surface bonding, preventing sand, pebbles, and other foreign objects from penetrating between the shoe body 0 and the inner shoe 13.

Figure 8:
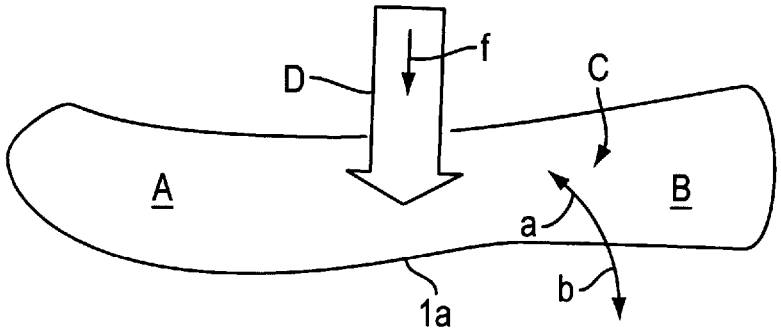
FIG. 8 is a schematic view illustrating how a bicycle shoe according to the present invention reacts to walking and pedaling forces.

FIG. 8 is a schematic view illustrating how a bicycle shoe according to the present invention reacts to walking and pedaling forces. When a person inserts both feet into the left and right inner shoes and starts walking, the curved surfaces of the soles of his feet are flexed. As shown in FIG. 8, the back portion B is rotated back and forth with respect to the front portion A, pivoting approximately at the inflection point la. The direction of reciprocated rotation is indicated by arrow C. It is known based on the strength of materials that the shoe body whose cross section at a position corresponding to the inflection point 1*a* as schematically shown in FIG. 8 can be easily rotated along arrow (a) of the rotation direction C but is difficult to rotate along arrow (b) of the rotation direction C. Such bending characteristics improve walking comfort. The shoe body 0 is made of a thin material and is thus lightweight while being strong overall. This also improves walking comfort.

A pedaling force f acts at a point such as that shown by arrow D. In such a case the back portion B tends to rotate in the direction of the arrow b with respect to the front portion A, but the bending characteristics prevent flexure rotation from occurring in this direction. The loss of energy generated by the pedaling force is therefore low. The shoe body 0 is made of a thin material and is thus lightweight while being strong overall.

The foot and the shoe can be secured together by adjusting the fastening force of the Velcro® straps 14. They may be secured in such a manner that there is no gap between the front/lower surface of the toes and the inner surface of the sole portion structure 1/toe portion structure 4, preventing the space from contracting due to foot movements. This also lowers energy loss. Walking comfort and energy efficiency are further improved by the presence of a low-grade portion 6. The longitudinal position of the coupling portion 8 in relation to the pedal can be adjusted with consideration for the positional relation with respect to the inflection point in order to obtain maximum efficiency.

Figures 10A, 10B, 10C, 10D, 10E, 10F, 10G:
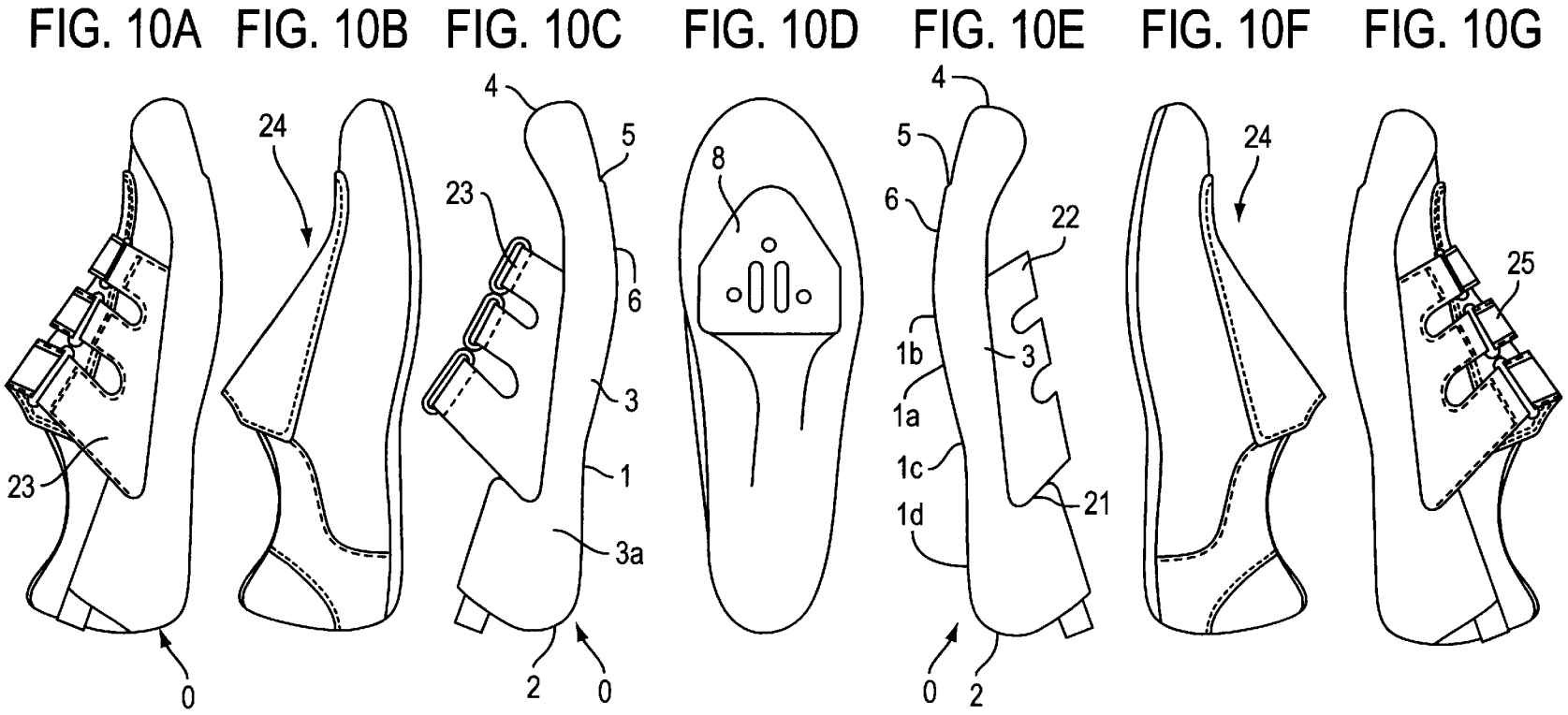

FIGS. 10(A)–7(G) show an alternative embodiment of a bicycle shoe according to the present invention at various stages of manufacture, wherein FIGS. 10(A)–7(C) are right side views of the shoe, FIG. 10(D) is a bottom view of the shoe, and FIGS. 10(E)–10(G) are left side views of the shoe. In this embodiment, the shoe body 0 comprises a sole structure 1, a heel portion structure 2, left and right side portion structures 3, and a toe portion structure 4. These components 1, 2, 3, and 4 are combined together by a monolithic molding means. In this respect, this embodiment is similar to the embodiment shown in FIGS. 7(A)–7(G). However, unlike the embodiments shown in FIGS. 7(A)–7(G), the material for the shoe body 0 in this embodiment may be carbonated fiber or carbon fiber. In this embodiment, emphasis is placed on energy efficiency rather than on walking comfort, stressing the qualities of skillful sports performance and competition. As a result, the shoe of this embodiment, while somewhat less optimum than the shoe of the first embodiment in terms of flexibility and walking performance, is excellent in terms of transmitting the pedaling force.

In this embodiment, the sole line of the sole structure 1 in the front cross section has an inflection point 1*a* roughly in the longitudinal central portion, an inflection point front portion 1*b* in front of the inflection point 1*a* is roughly in the form of a convex surface, an inflection point back portion 1*c* behind the aforementioned inflection point 1*a* is roughly in the form of a concave surface, a heel portion bottom 1*d* that follows the inflection point back portion 1*c* and is continuous with it is shaped partially as an essentially convex surface and partially as an essentially flat surface. Thus, the sole structure 1 comprises the inflection point front portion 1*b*, inflection point back portion 1*c*, and heel portion bottom 1*d*. In this respect, this embodiment is similar to the first embodiment.

Another feature that makes this embodiment similar to the first embodiment is that the heel portion structure 2 is continuously and smoothly connected to the back end portion of the heel portion bottom 1*d* of the sole portion structure 1, and is shaped as a convex curved surface that resembles the convex curved surface of the back of the heel of the foot. Yet another feature that makes this embodiment similar to the first embodiment is that the left and right side portion structures 3, which are smoothly and continuously connected to the left and right end portions of the sole portion structure 1 and to the heel portion structure 2, rise essentially vertically and that the left and right side portion structures 3 are slightly curved in such a way that the distance between them decreases in the upward direction.

Still another feature that makes this embodiment similar to the first embodiment is that the toe portion structure 4 is smoothly and continuously connected to the front end portions of the left and right side portion structures 3 and the sole portion structure 1. Viewed in a lateral cross section, the front portion of the toe portion structure 4 has a closed contour line as the form line of the toe portion structure 4 and is shaped as a convex surface. The leading surface thereof is shaped as a convex curved surface that resembles the convex curved surface of the leading surfaces of the leading portions of all the toes of the foot and that runs along this convex curved surface. That is, the radius of curvature of the curve in the front cross section of the connecting portion designed to ensure a continuous and smooth connection of the sole structure 1 to the toe portion structure 4 is roughly equal to the radius of curvature of each toe. As in the first embodiment, the inflection point front portion 1*b* is provided with a low-grade portion 6 which is separated from the toe portion structure 4 by a stepped portion 5 and which is shaped as a lower-grade step in a continuous manner.

The difference between this embodiment and the first embodiment is that the back portions 3*a* of the left and right side portion structures 3 are separated by a stepped portion 21 and that they are higher than the central portions of the left and right side portion structures 3. As shown in FIGS. 10(C) and 10(E), left and right base portions 22 and 23 for attaching Velcro® straps made of a fiber-containing rubber are attached to the inner surfaces on both sides of the central portions of the left and right side portion structures 3. These left and right base portions 22 and 23 are integrated with the shoe body 0 by inserting the shoe body 0 into an injection mold, injecting a fiber-containing rubber material, and performing insert molding integrally with the shoe body 0, or by inserting molded left and right base portions 22 and 23 into an injection mold, injecting a carbon fiber or other material and performing insert molding to integrate the shoe body with the left and right base portions 22 and 23. A ring 25 is attached to one of the base portions 23.

An inner shoe 24 such as that shown in FIGS. 10(B) and 10(F) is inserted into the shoe body 0 along the inner surface of the shoe body 0. The left and right base portions 22 and 23 and the inner shoe 24 are stitched together by a sewing means, as shown in FIG. 10(G). A Velcro® strap 25 is stitched to one of the base portions 22 by a sewing means.

Figure 11:
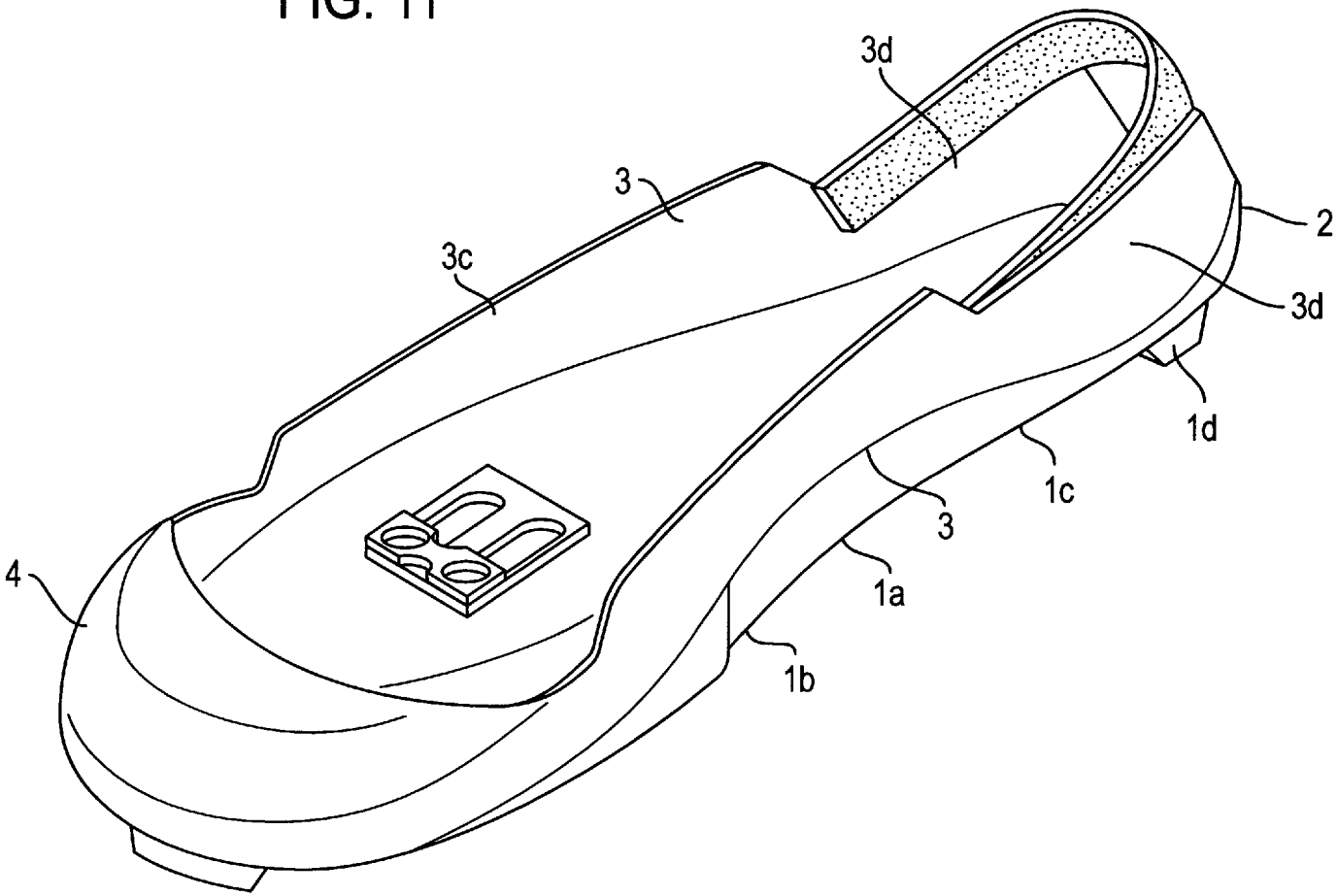
FIG. 11 is a perspective view of another alternative embodiment of a shoe body according to the present invention.
Figure 12:
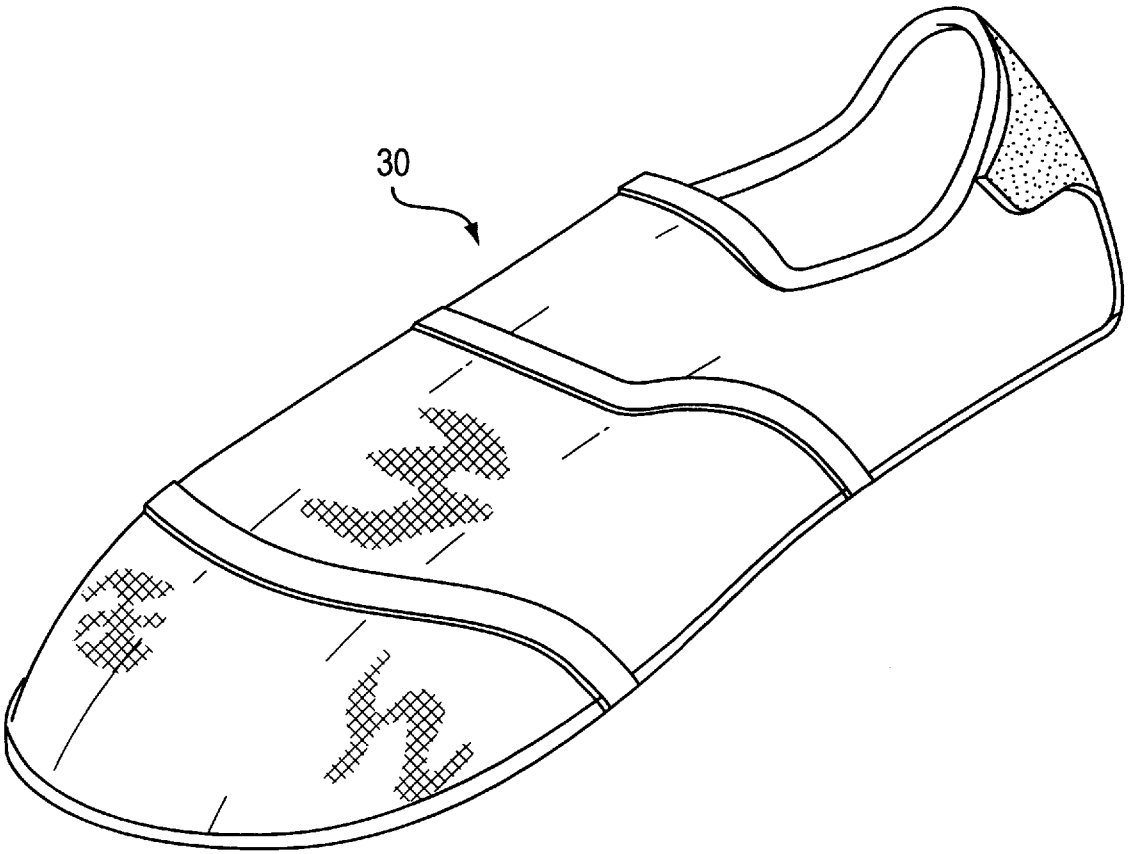
FIG. 12 is a perspective view of an inner shoe body which may be used with the inner shoe body shown in FIG. 11.
Figure 13:
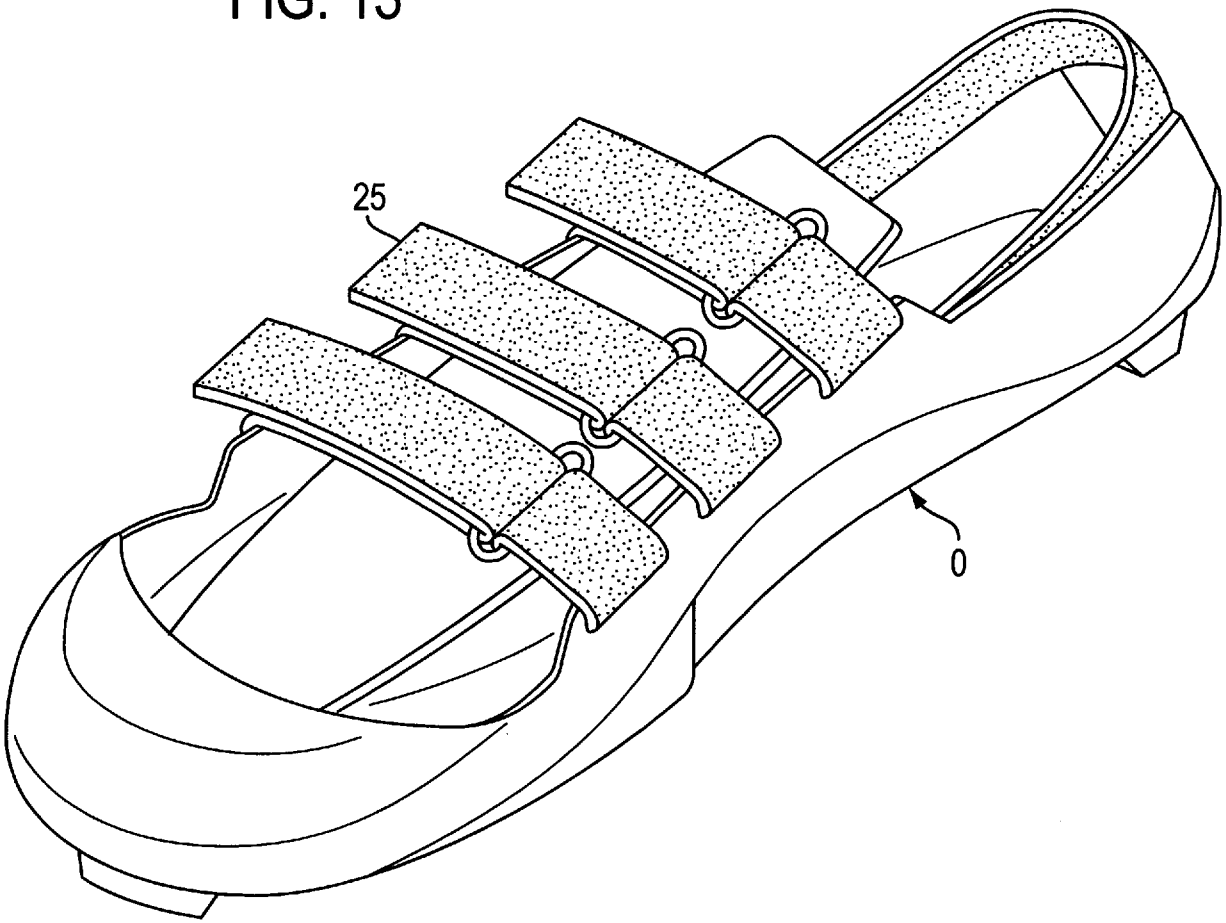
FIG. 13 is a perspective view of the shoe body shown in FIG. 11 with fastening straps installed.

FIGS. 11 through 13 show another alternative embodiment of a bicycle shoe according to the present invention. In this embodiment, bending is reduced for forces acting in the directions shown by arrows b and D in FIG. 8.

The structures of the sole structure 1, heel portion structure 2, left and right side portion structures 3, and toe portion structure 4 are the same as in the first and second embodiments. The left and right side portion structures 3 of this embodiment are a continuation of the toe portion structure 4, and the central portions 3*c* of the left and right side portion structures are higher than the heel portion structure 2, the back portions 3*d* of the left and right side portion structures 3, or the toe portion structure 4.

FIG. 12 shows an inner shoe 30 which can be inserted into the shoe body 0 in FIG. 11, and FIG. 13 shows the result of attaching Velcro straps 25 to the central portions 3*c* of the left and right side portion structures without introducing the inner shoe 30 into the shoe body 0.

While the above is a description of various embodiments of the present invention,4 further modifications may be employed without departing from the spirit and scope of the present invention. For example, the material is not limited to a resin or carbon, and aluminum alloys, titanium alloys, and other metals can also be used. Monolithic molding of the inner shoe and the body is also possible. Thus, the scope of the invention should not be limited by the specific structures disclosed. Instead, the true scope of the invention should be determined by the following claims. Of course, although labeling symbols are used in the claims in order to facilitate reference to the figures, the present invention is not intended to be limited to the constructions in the appended figures by such labeling.

What is claimed is:

1. A bicycle shoe comprising:

a sole portion (1) including:

an inflection point (1*a*) substantially in a longitudinal central portion of the sole;

an inflection point from portion (1*b*) in front of the inflection point (1*a*), the inflection point front portion (1*b*) having a convex shape; and an inflection point back portion (1*c*) behind the inflection point (1*a*), the inflection point back portion (1*c*) having a concave shape;

a heel portion (2) which is continuously and smoothly connected to a back end portion of the sole portion (1), the heel portion (2) having convex shape for fitting to a heel;

left and right side portions (3) which are smoothly and continuously connected to corresponding left and right side portions of the sole portion (1) and to the heel portion (2); and a toe portion (4) which is smoothly and continuously connected to front end portions of the left and right side portion (3) and to a front end portion of the sole portion (1), the toe portion (4) extending upwardly and rearwardly from the front end portion of the sole portion (1) and terminating at a rear end that is spaced apart from the sole portion (1) so that the toe portion (4) forms a cup shape having a contour line that is closed within a lateral cross section thereof and which has a convex shape;

wherein the sole portion (1), the heel portion (2), the left and right side portions (3), and the toe portion (4) are formed as one piece;

wherein the inflection front portion **(1*b*) includes a coupling portion (8) for attachment of a coupler so that the bicycle shoe may be coupled to a bicycle pedal; and wherein the coupling portion (8) includes first and second elongated openings (9)**.

2. A bicycle shoe comprising:

a sole portion (1) including:

an inflection point **(1*a*)** substantially in a longitudinal central portion of the sole;

an inflection point front portion **(1*b*) in front of the inflection point (1*a*), the inflection point front portion (1*b*) having a convex shape; and an inflection point back portion (1*c*) behind the inflection point (1*a*), the inflection point back portion (1*c*)** having concave shape;

a heel portion (2) which is continuously and smoothly connected to a back end portion of the sole portion (1), the heel portion (2) having convex shape for fitting to a heel;

left and right side portions (3) which are smoothly and continuously connected to corresponding left and right side portions of the sole portion (1) and to the heel portion (2); and a toe portion (4) which is smoothly and continuously connected to front end portions of the left and right side portion(3) and to a front end portion of the sole portion (1), the toe portion (4) extending upwardly and rearwardly from the front end portion of the sole portion (1) and termination at a rear end that is spaced apart from the sole portion(1) so that the toe portion (4) forms a cup shape having a contour line that is closed within a lateral cross section thereof and which has a convex shape;

wherein the sole portion (1), the heel portion (2), the left and right side portions (3), and the toe portion (4) are formed as one piece;

wherein the inflection front portion **(1*b*) includes a coupling portion (8) for attachment of a coupler so that the bicycle shoe may be coupled to a bicycle pedal; and wherein the inflection point front portion (1*b*) is provided with a downwardly extending portion (6) that is separated from the toe portion (4) by a stepped portion (5), and wherein the downwardly extending portion (6) is formed as one piece with the sole portion (1)**.

* * * * *